US005516033A

United States Patent [19]

Bernetich

[11] Patent Number: 5,516,033

[45] Date of Patent: May 14, 1996

[54] MULTI-LEAVED GREETING CARD WITH INTEGRAL ENVELOPE

[75] Inventor: Kathleen A. Bernetich, Brecksville, Ohio

[73] Assignee: American Greetings Corporation, Cleveland, Ohio

[21] Appl. No.: 39,954

[22] Filed: Mar. 30, 1993

[51] Int. Cl.[6] ..... B65D 27/00

[52] U.S. Cl. ..... 229/92.7; 229/92.8; 283/117; 493/243

[58] Field of Search ..... 229/305, 92, 92.1, 229/92.7; 283/117; 493/243, 921

[56] References Cited

U.S. PATENT DOCUMENTS

| | | | |
|---|---|---|---|
| 814,437 | 3/1906 | Endean | 229/306 |
| 893,202 | 7/1908 | Shaw . | |
| 1,071,491 | 8/1913 | Witmer . | |
| 1,267,034 | 5/1918 | Winfield . | |
| 1,394,362 | 10/1921 | Schulman . | |
| 1,402,635 | 1/1922 | Meyer . | |
| 1,693,811 | 12/1928 | Dziuk | 229/92.8 |
| 1,753,663 | 4/1930 | Miller . | |
| 1,777,499 | 10/1930 | Lupfer . | |
| 1,994,393 | 3/1935 | Hopkins . | |
| 2,005,999 | 6/1935 | Larson | 229/92.7 |
| 2,354,066 | 7/1944 | Sass | 229/92.1 |
| 2,497,064 | 2/1950 | Baynes | 229/92.8 X |
| 2,986,325 | 5/1961 | Loderhose . | |
| 3,159,329 | 12/1964 | Hiersteiner . | |
| 3,190,541 | 6/1965 | McLaughlin et al. . | |
| 3,199,768 | 8/1965 | Farmlett . | |
| 3,347,449 | 10/1967 | Behal . | |
| 3,352,481 | 11/1967 | Kirchof | 29/92.1 |
| 3,399,825 | 9/1968 | Kirchof | 229/92.8 |
| 3,713,673 | 1/1973 | Katz . | |
| 3,826,422 | 7/1974 | Dickinson . | |
| 4,070,778 | 1/1978 | Mahler et al. | 229/92.8 X |
| 4,140,317 | 2/1979 | Ramney . | |
| 4,167,241 | 9/1979 | Zumbrunn . | |
| 4,422,552 | 12/1983 | Palmer et al. . | |
| 4,558,980 | 12/1985 | Sturdivan . | |
| 4,697,364 | 10/1987 | Dean . | |
| 4,724,996 | 2/1988 | Everett . | |
| 4,826,211 | 5/1989 | Sinnott et al. | 283/117 |
| 4,828,105 | 5/1989 | Silengo et al. . | |
| 5,004,271 | 4/1991 | Piatt | 229/92.8 X |
| 5,135,157 | 8/1992 | Cruz . | |

FOREIGN PATENT DOCUMENTS

| | | | |
|---|---|---|---|
| 456772 | 9/1913 | France | 229/92.7 |
| 839285 | 3/1939 | France . | |
| 1570450 | 10/1967 | France . | |
| 106789 | 10/1924 | Germany | 229/92.7 |
| 3511529A1 | 10/1986 | Germany . | |
| 3207 | of 1888 | United Kingdom | 229/92.1 |

*Primary Examiner*—Jes F. Pascua
*Attorney, Agent, or Firm*—Calfee Halter & Griswold

[57] ABSTRACT

A multi-leaved social expression card with an integral envelope has first and second leaves joined together along a first score line and foldable into overlying relationship with each other to form a social expression card. The first and second leaves can have social expression thereon identifying the sending situation for the card. A third leaf is joined to the second leaf along a second score line, and is foldable into overlying adjacent relationship with the first leaf such that the third leaf substantially covers and protects the outer surface of the first leaf. A flap is joined to the third leaf along a third score line. The flap is foldable into overlying adjacent relationship with the second leaf when the first, second and third leaves are folded together. The flap includes an adhesive structure which adhesively secures the flap to the second leaf to form an envelope. The flap also includes an additional social expression identifying the sending situation for the social expression card. Additionally, the third leaf is foldable into overlying adjacent relationship with the second leaf when the social expression card is displayed. In this case, the flap extends upwardly over the folded card and the social expression thereon is visible to provide a locator function for the social expression card.

23 Claims, 7 Drawing Sheets

MULTI-LEAVED GREETING CARD WITH INTEGRAL ENVELOPE

FIELD OF THE INVENTION

The present invention relates generally to greeting cards.

BACKGROUND OF THE INVENTION

A popular type of greeting card comprises two or more leaves folded together widthwise along a score line into overlying relationship with each other. Social expression, e.g., graphics and/or verse, is typically included on the outer surface of the front leaf. Additional social expression can be included on the inside surface of the rear leaf. Such a greeting card is illustrated in FIG. 1.

A customer generally chooses a greeting card having a social expression for a particular sending situation, and adds a personalized message on the inside surface of the card. The card is then folded and inserted into a separate envelope. An envelope for this type of greeting card typically consists of a sheet of paper cut in a predetermined shape, folded and sealed to form a pocket for the card. When the card is inserted into the envelope, a gummed flap is folded over to enclose the card within the envelope. Such an envelope is illustrated in FIGS. 2A and 2B.

To send or mail this type of greeting card therefore requires two separate components, i.e., the greeting card component and the envelope component. These two components are conventionally manufactured separately, but are displayed proximate one another at a retail establishment. In particular, the greeting cards are typically located in lengthwise stacked relation on a display rack, while a plurality of appropriately-sized envelopes are stacked immediately therebehind.

Although the above described type of greeting card has been popular for long periods of time, the separate envelope for this card has certain disadvantages. For example, the envelope is formed independently from the greeting card and requires a certain amount of time, labor and material cost to produce. Further, additional time and labor cost are incurred in arranging the stack of envelopes behind the cards on the display rack. Moreover, material waste can occur if the number of envelopes does not exactly match the number of greeting cards when displayed.

One type of known greeting card which appears to have overcome some of these disadvantages is shown in Cruz, U.S. Pat. No. 5,135,157. Cruz discloses a combined envelope and greeting wherein a pair of leaves are foldable into overlying relationship with each other and adhesively secured along the edges using peel-away adhesive strips. An additional flap is provided integral with the front leaf and folds rearwardly to be adhesively secured to the outer surface of the rear leaf. Upon receipt, the recipient opens the card by tearing along perforations to remove the edges of the leaves, and then tearing along a perforation joining the flap to the front leaf.

The Cruz card provides certain advantages over the previously-described popular greeting cards in that a separate envelope is not necessary for sending the card through the mail. Hence, time, labor and material savings can be realized in both manufacturing the card and displaying the card on the display rack.

However, even this type of greeting card is not without drawbacks. For example, the front leaf of the Cruz card is exposed during mailing—which can tear the front leaf or mar the social expression thereon. Further, the Cruz card does not lend itself to being easily displayed on a rack so as to facilitate choosing an appropriate card for a particular sending situation. Rather, the purchaser only has the social expression on the outer front surface of the card from which to guess the sending situation for the card. This typically requires removal of the card from the display rack and reading the additional social expression printed on the inside of the card.

In any case, there is a constant demand in the marketplace for new and improved types of greeting cards, and in particular greeting cards which reduce time, labor and material costs, both in manufacturing and in display.

SUMMARY OF THE INVENTION

The present invention provides a novel and unique type of greeting card with an integral envelope. The greeting card reduces time, labor and material costs, both in manufacturing and in display of the card. In addition, the greeting card has a unique structure which allows it to be displayed in such a manner to facilitate choosing an appropriate greeting card for a particular sending situation.

The greeting card of the present invention preferably includes first and second leaves which are foldable along a score line into adjacent overlying relationship with each other. Appropriate social expression can be included on the outer surface of the front leaf, as well as on the inner surface of the rear leaf.

A third leaf is joined preferably to the bottom edge of the rear leaf of the greeting card along a perforated score line and extends downwardly therefrom. The third leaf has substantially the same dimensions as the front and rear leaves, and when the front and rear leaves are folded together, the third leaf can be folded into adjacent, overlying relationship with the front leaf to cover and protect the front leaf. The third leaf also has a flap with an adhesive layer which can then be folded rearwardly into adjacent, overlying relationship with the rear leaf and adhesively secured thereto to form an envelope.

The third leaf can have address information, additional artwork and/or lettering printed thereon for sending the envelope through the mail, while additional social expression can be included on the outer surface of the flap. The greeting card can be folded such that the social expression on the flap is visible when the greeting card is located on a display rack to provide an additional indication of the sending situation for the card and thereby facilitate choosing an appropriate greeting card. The social expression on the flap also serves to provide the recipient of the mailed greeting card with an idea of the social expression contained within the card.

Upon receipt, the third leaf can be removed from the greeting card along the perforation with the rear leaf, and along a perforation on the flap, to reveal the social expression on the card. After the card is opened, only the front leaf, the rear leaf, and the flap (with the social expression thereon) remain. Alternatively, the flap can be removed along with the third leaf.

Accordingly, it is a basic object of the present invention to provide a greeting card with an integral envelope which reduces time, labor and material costs in manufacturing and displaying the greeting card.

It is another object of the present invention to provide an additional social expression and/or artwork on the greeting card which relates to the sending situation and which is visible when the card is displayed on a display rack, as well as when the card is received in the mail.

It is yet another object of the present invention to provide a greeting card with an integral envelope that is simple and easy to use, and that has the social expression on the front surface of the card protected when the card is mailed.

Further, it is another object of the present invention to provide a greeting card structure such that retailer does not have to provide, and the purchaser does not have to locate a separate envelope for the greeting card.

Further objects of the present invention will become apparent from the following detailed description and accompanying drawings which form a part of the specification.

DETAILED DESCRIPTION OF THE PREFERRED EMBODIMENT

Figure 1:
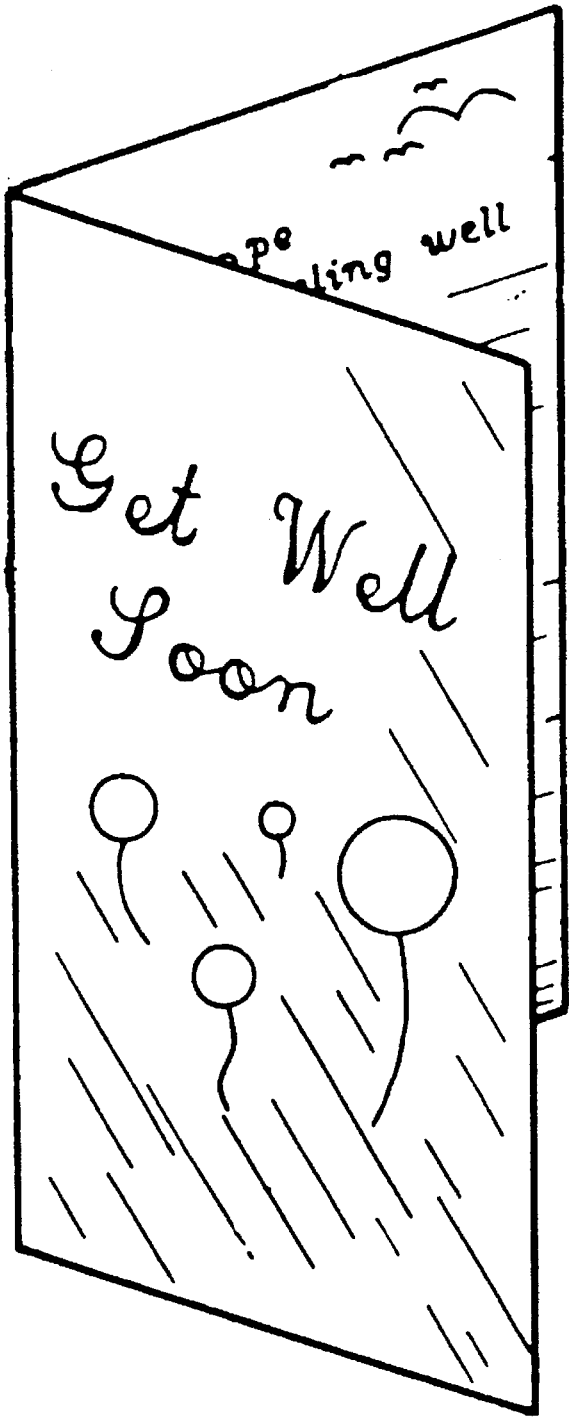
FIG. 1 PRIOR ART
FIG. 1 is a front perspective view of a conventional type of greeting card.
Figure 2A:
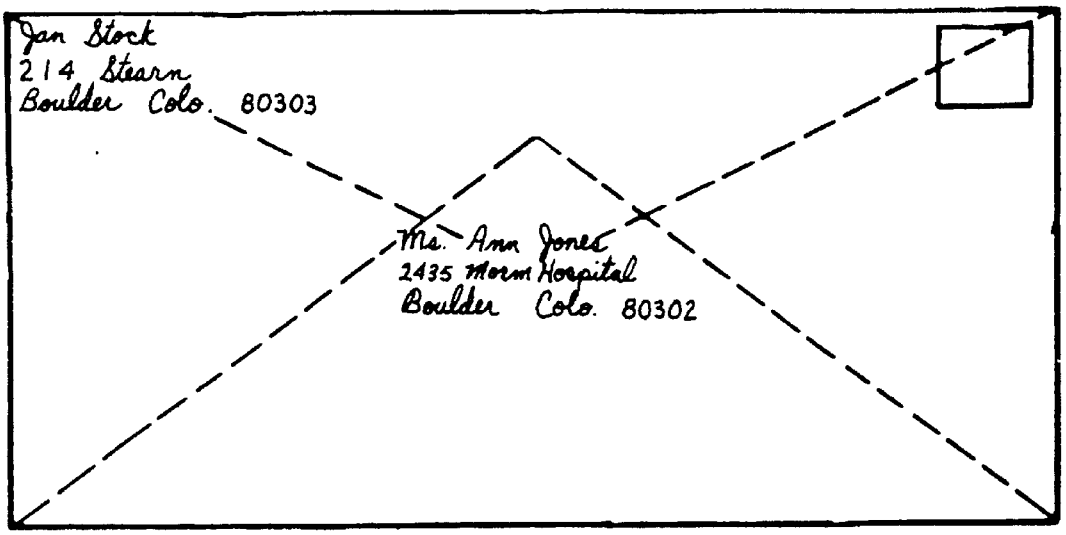
FIG. 2A PRIOR ART
FIG. 2A is a front view of a conventional type of envelope for the greeting card of FIG. 1.
Figure 2B:
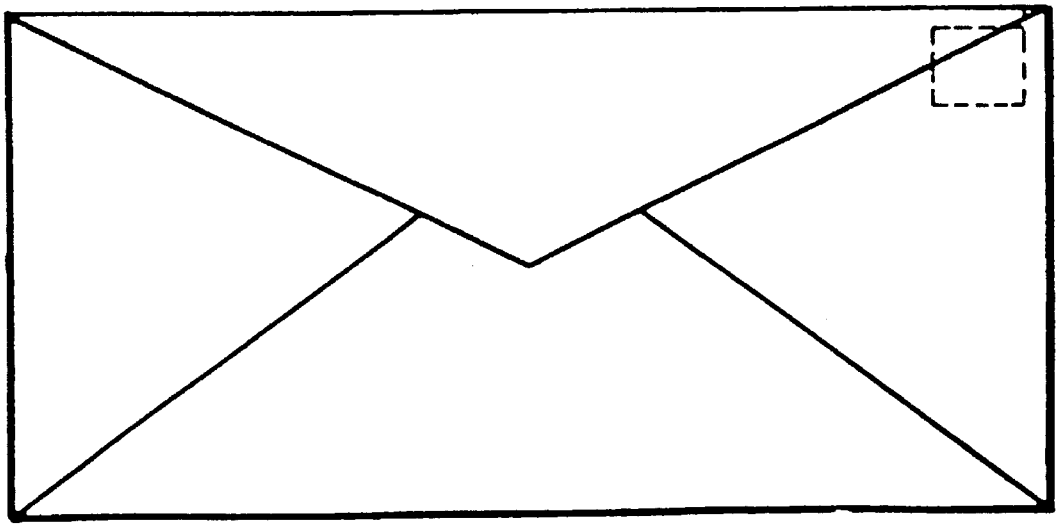
FIG. 2B is a rear view of the envelope of FIG. 2A.
Figure 4:
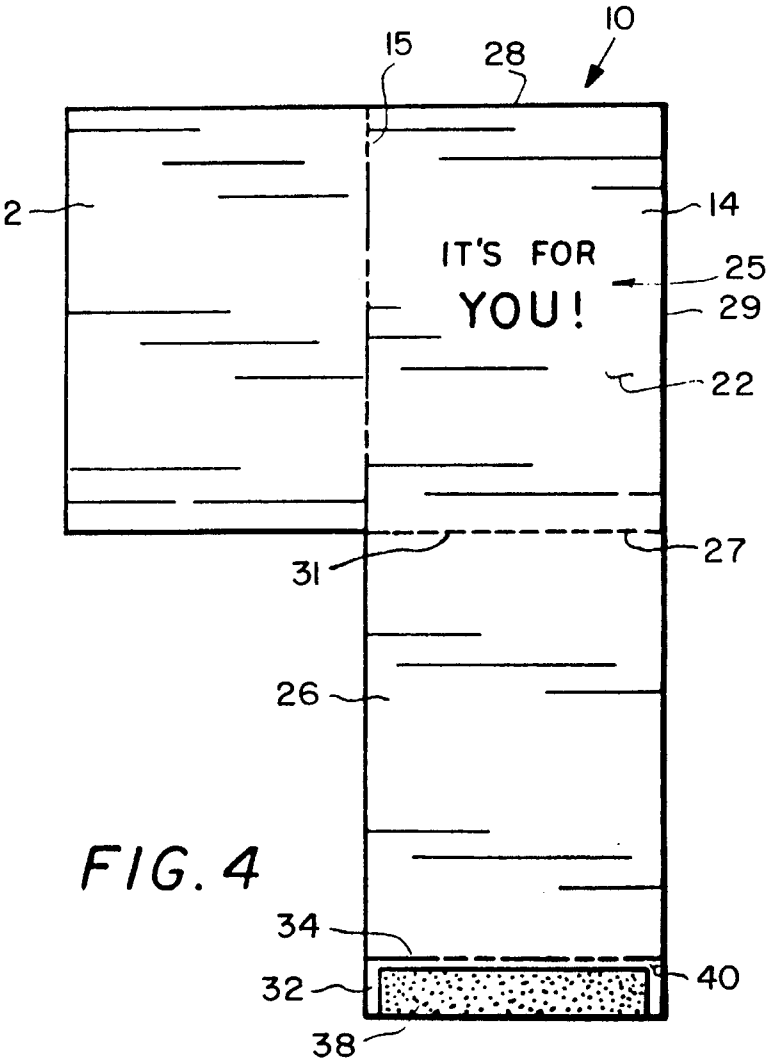
FIG. 4 is a rear plan view of the greeting card with integral envelope of FIG. 3.
Figure 3:
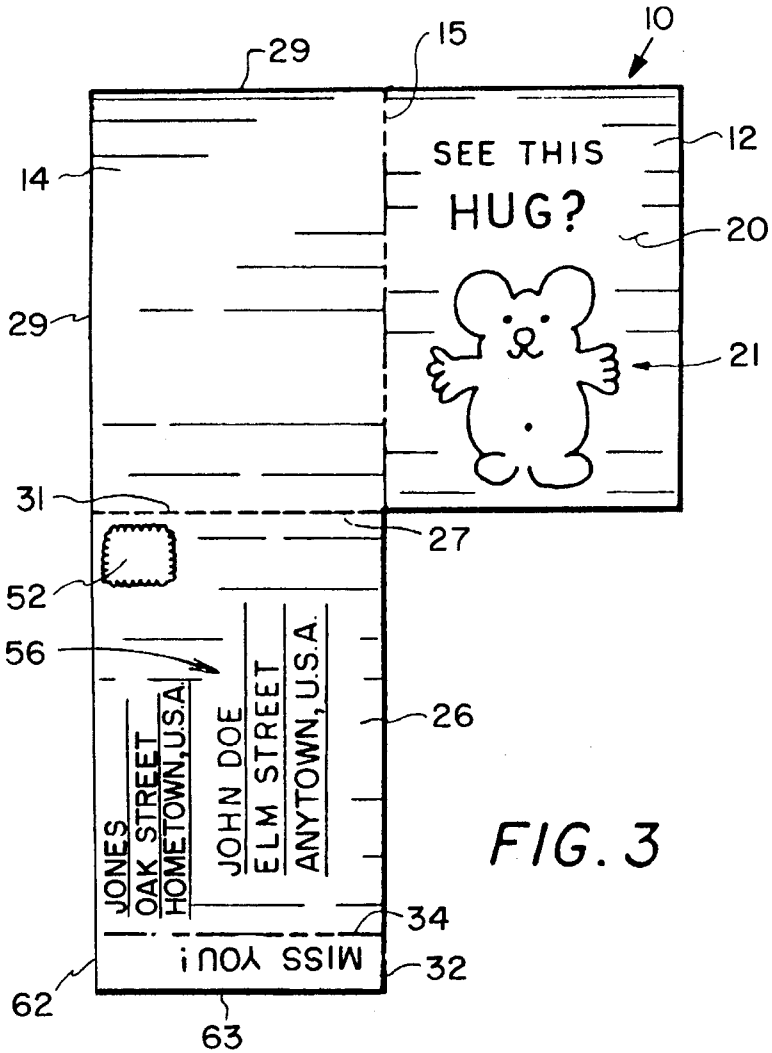
FIG. 3 is a front plan view of the greeting card with integral envelope of the present invention.
Figure 5:
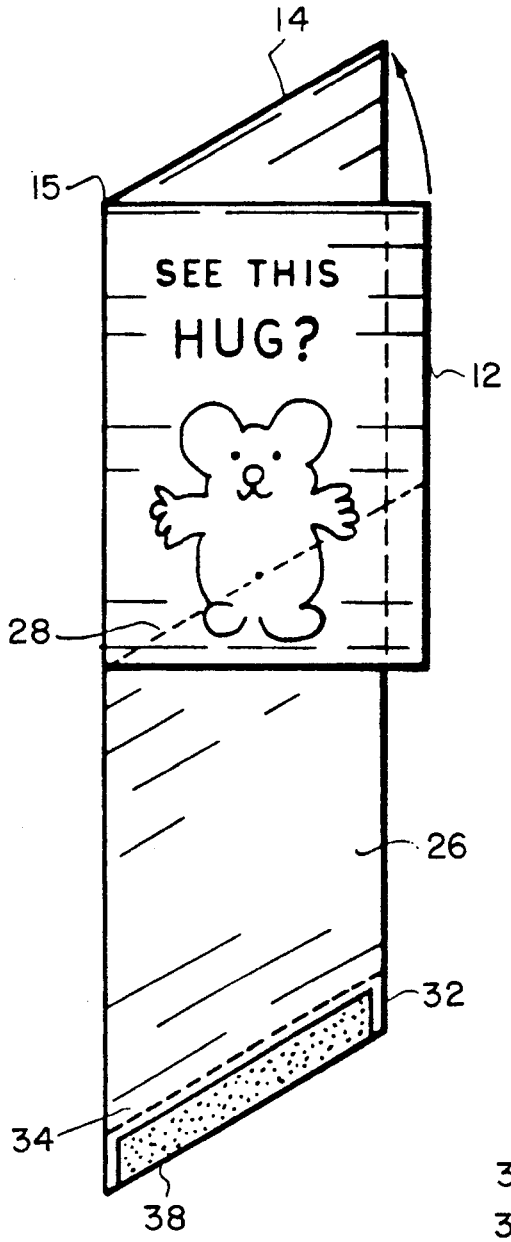
FIG. 5 is a partially assembled view of the greeting card with integral envelope of FIG. 3 illustrating the front leaf folded into overlying relationship over the rear leaf in a first assembly step.

Referring to the drawings, and initially to FIGS. 3 and 4, the greeting card structure of the present invention includes a sheet 10, which is preferably formed from heavy paper or cardboard-type material. The sheet 10 is cut, scored and printed using conventional processes which should be known to those skilled in the art. In particular, the sheet 10 is cut so as to form a first, front leaf 12 and an integral second, rear leaf 14 which are foldable along a score line 15 into adjacent overlying relationship with each other (see, e.g., FIG. 5).

The front leaf 12 and rear leaf 14 preferably have the same dimensions (e.g., rectangular), however it should be apparent to those skilled in the art that other dimensions for the front leaf could be used (e.g., round, square, etc.), or that each leaf could have a different dimension than the other leaf. It should also be apparent to those skilled in the art that the present invention is also applicable to greeting cards formed from other than two leaves, for example, three or more leaves can be joined together and foldable relative to each other to form the greeting card. Alternatively, the greeting card could be formed from only a single leaf.

In any case, the front surface 20 of the front leaf 12 typically includes social expression, e.g., graphics and/or verse (identified generally at 21 in FIG. 3) printed thereon which identifies the sending situation of the greeting card. Likewise, the rear leaf 14 has an inside surface 22 which typically also includes social expression (identified generally at 25 in FIG. 4) printed thereon which also relates to the sending situation for the greeting card. Additional personalized social expression can be supplied by the sender on the inside surface of the front and rear leaves as is typical with greeting cards.

The front leaf 12 and rear leaf 14 together form the greeting card portion of the greeting card structure. However, the greeting card structure further includes an integral envelope portion which enables the greeting card to be sent through the mail.

To this end, a third leaf 26 is formed integrally, and preferably in one piece with, the rear leaf 14 of the greeting card during the initial cutting process. The third leaf 26 preferably extends downwardly from and is contiguous with the bottom edge 27 of the rear leaf 14; however, it should also be apparent to those skilled in the art upon reading this specification that the greeting card structure could also be formed such that the third leaf 26 extends upwardly from the top edge 28 of the rear leaf 14 (or outwardly from the side edge 29). In either of these cases, the principles of the present invention would be equally applicable.

Figure 6:
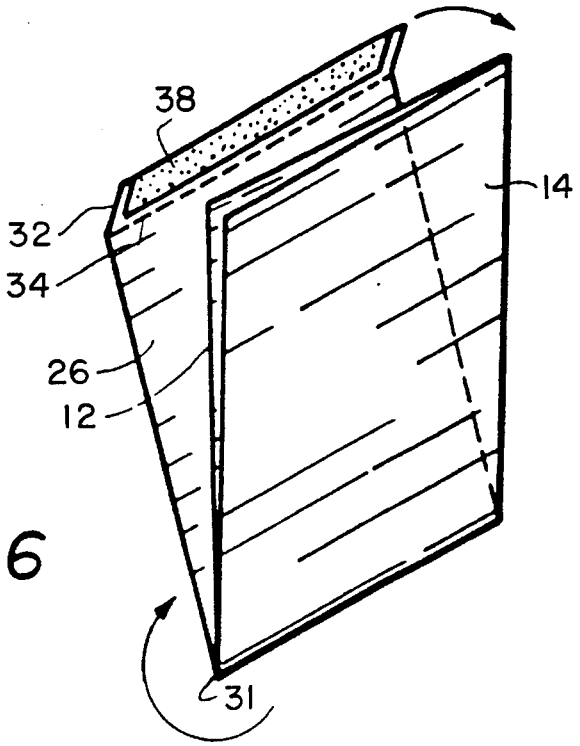
FIG. 6 is a further assembly step of the greeting card with integral envelope of FIG. 3, illustrating the third leaf folded into overlying relationship with the first and second leaves.

The third leaf 26 is foldable along a score line 31, which is preferably perforated, such that the third leaf 26 can be folded into adjacent overlying relationship with front leaf 12 after the front leaf 12 and rear leaf 14 are folded together (see, e.g., FIG. 6). When the third leaf is folded in this manner, the third leaf covers preferably the entire outer front surface of the front leaf and thereby protects the social expression 21 on the front leaf. This third leaf 26, together with the rear leaf 14, form the envelope portion of the greeting card structure. As will be discussed herein in more detail, the third leaf can be easily removed from the front and rear leaves by tearing the third leaf 26 along the perforated score line 31.

Figure 11:
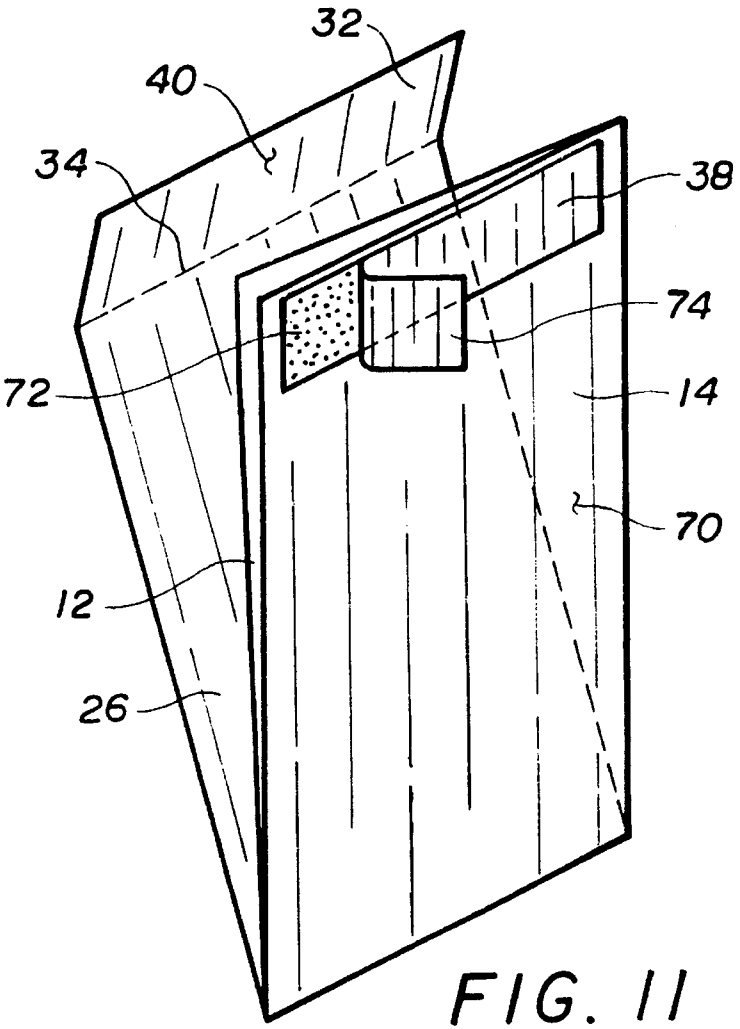
FIG. 11 is a perspective view of the greeting card with integral envelope of FIG. 3 illustrating an adhesive structure comprising an adhesive strip with a peel-away cover.
Figure 10:
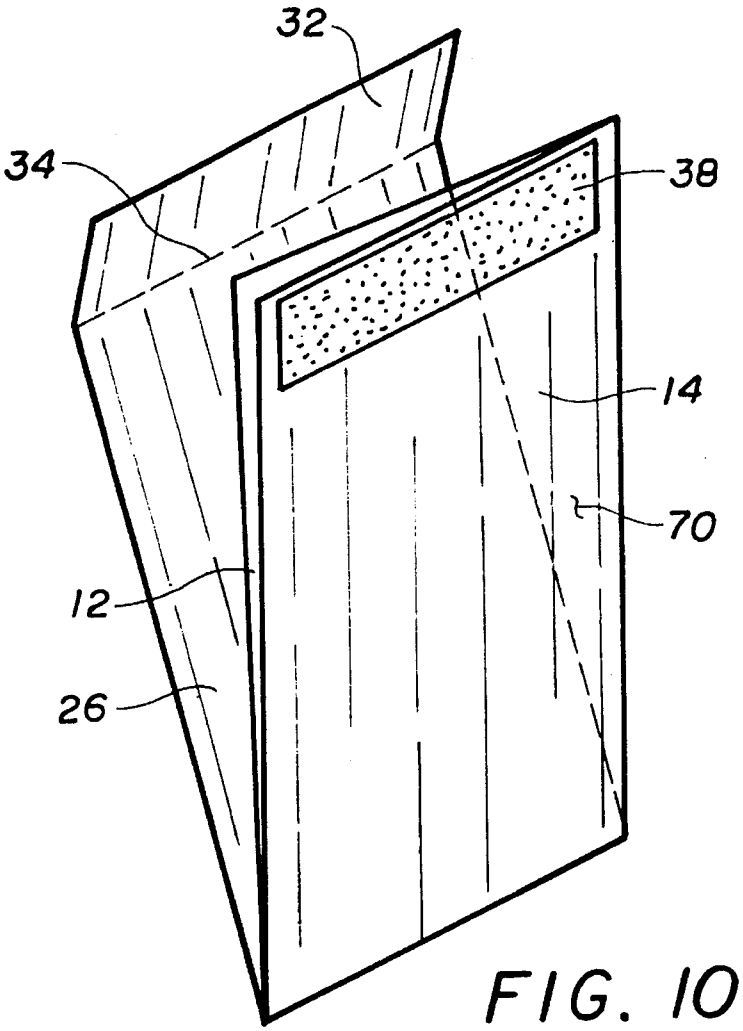
FIG. 10 is a perspective view of the greeting card with integral envelope of FIG. 3 illustrating an alternate placement of the adhesive structure.

The third leaf 26 further includes a flap 32 which is joined in one piece to the bottom edge of the third leaf 26 along a second score line 34, which is also preferably perforated. An adhesive structure 38 is formed on the inside surface 40 of the flap 32. In the alternative, the adhesive structure 38 could be formed on one of the other leaves, e.g., the rear surface 70 of the rear leaf 14, as shown in FIGS. 10 and 11, to adhesively secure the flap to the rear leaf, Examples of suitable adhesive structures 38 include a gummed adhesive, shown in FIGS. 4–6 and 10, and an adhesive strip 72 with a peel-away cover 74, shown in FIG. 11. The adhesive structure 38 on the flap 32 facilitates securing the third leaf 26 to the rear leaf 14 when the leaves are folded together. Further, the third leaf 26 and flap 32 can be separated along second perforated score line 34, as will be described herein in more detail.

Referring now to FIGS. 5–8, the method of use of a greeting card constructed according to the present invention will be briefly explained. As described above, the front leaf 12 and rear leaf 14 form the greeting card portion of the greeting card structure. A purchaser can provide a personal message on any of the leaves which relates to the sending situation of the greeting card. The front leaf 12 is then folded into overlying relationship with the rear leaf 14 along score line 15. The third leaf 26 is then folded into adjacent overlying relationship with the front leaf 12, such as shown in FIG. 6, along perforated score line 31. The third leaf 26 is illustrated as being folded upwardly over the front leaf 12; however, if the third leaf 26 is formed along the top edge or side edge, the third leaf will be folded downwardly or from the side, respectively, to cover the front leaf 12.

Figure 7:
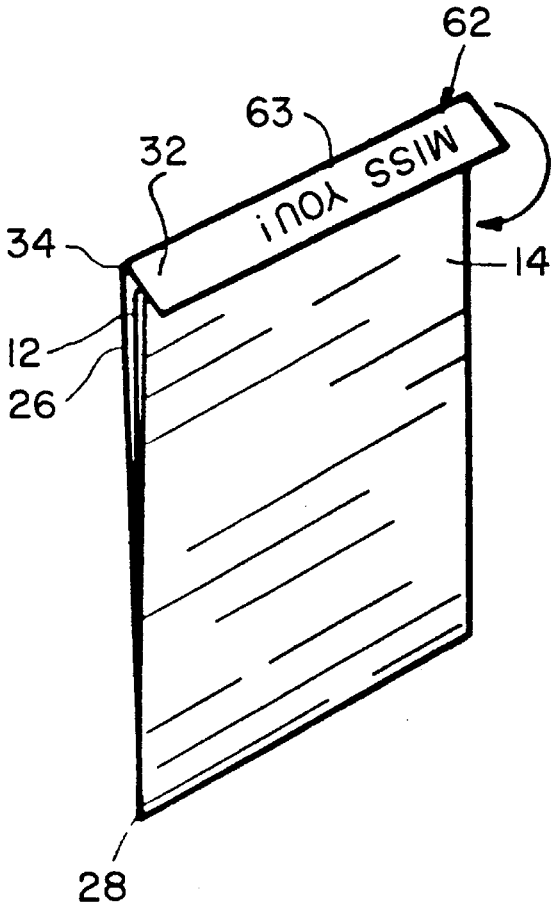
FIG. 7 is a further assembled view of the greeting card with integral envelope illustrating the leaves folded together.

The flap 32 is then folded into adjacent overlying relationship with rear leaf 14 along score line 34, as illustrated in FIG. 7. At this point, the adhesive structure 38 can adhesively secure the flap 32 to the outer surface of the rear leaf 14, such as by removing the cover of an adhesive strip, or moistening the gummed adhesive.

Figure 8:
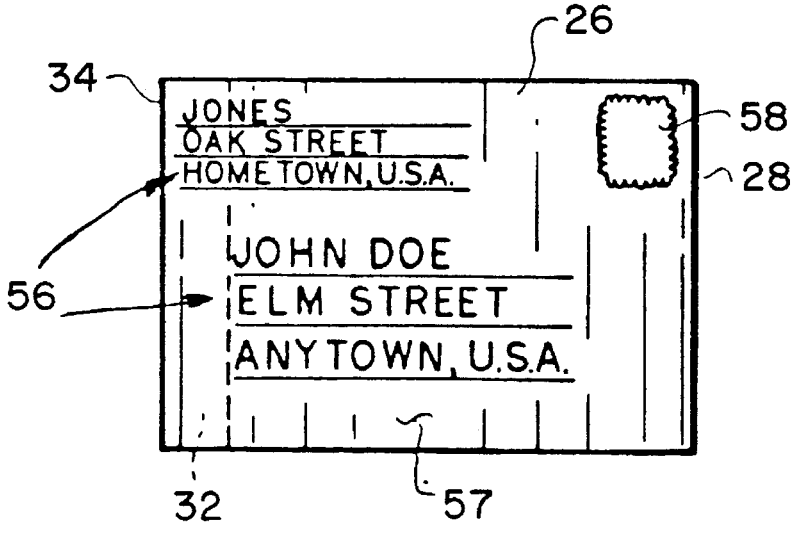
FIG. 8 is a front view of the fully-assembled greeting card with integral envelope of FIG. 3.

The fully assembled greeting card structure is illustrated in FIG. 8. Address information and/or additional artwork to decorate the envelope portion, indicated generally at 56, can be included on the outer surface 57 of the third leaf 26, and a stamp 58 can be affixed to the third leaf 26 for sending through the mail. The greeting card of the present invention particularly lends itself to having a prepaid postage stamp affixed to the envelope portion of the card since the envelope portion of the card remains integral with the card itself. Moreover, if desired, additional social expression and/or artwork can be easily printed on the outer surface 57 of the third leaf 26 (which forms the envelope portion of the card), because this surface is on the same side of the sheet 10 as the outer surface 20 of the first leaf 12, which is also being printed during the initial cutting, printing and folding process.

In any case, upon receipt, the recipient merely removes the third leaf 26 by tearing the third leaf 26 along the first and/or second score lines 28, 34, to reveal the outer surface of the front leaf 12 of the greeting card.

After opening, the flap 32 on the greeting card can remain adhesively secured to the outer surface of the rear leaf 14, and because of its relatively smaller size as compared to any of the first, second or third leaves, the flap does not detract from the social expression on the greeting card. Alternatively, the flap 32 can be removed when/if the third leaf 26 is separated from the rear leaf 14.

Moreover, the flap 32 can include an additional social expression, indicated generally at 62 in FIG. 3, printed on the outer surface 63 of the flap, which also relates to the sending situation for the greeting card. This additional social expression on the flap 32 serves many purposes.

Figure 9:
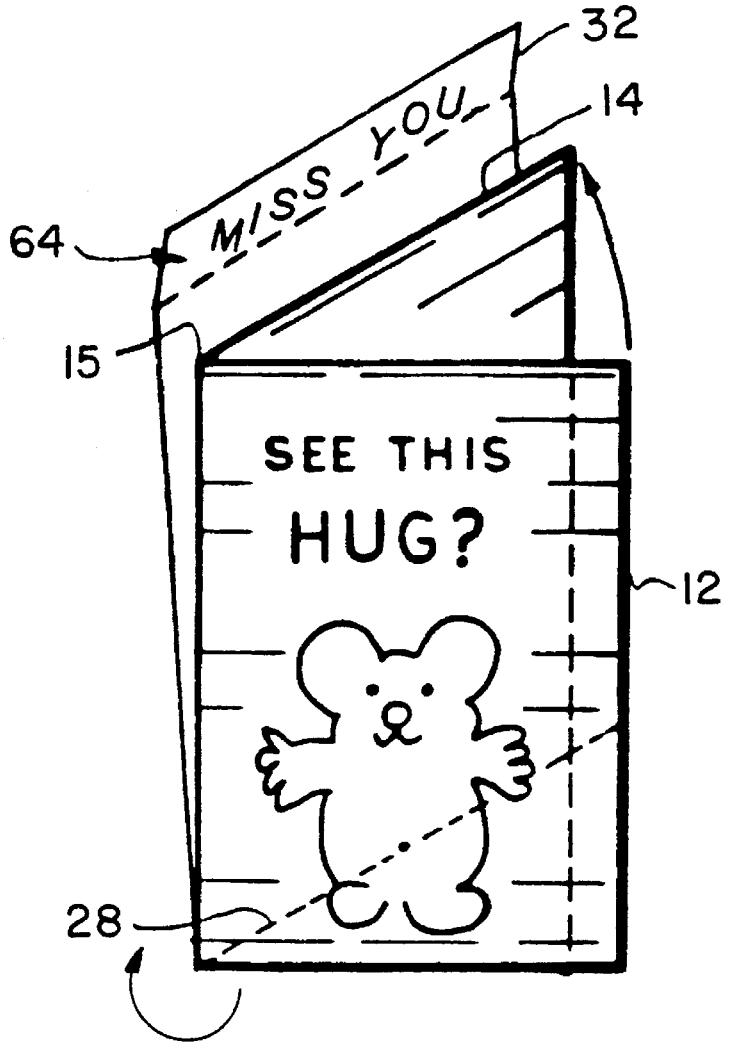
FIG. 9 is a perspective view of the greeting card with integral envelope of FIG. 3 illustrating the greeting card in its display position.

For example, the greeting card can be folded such that the social expression on the flap 32 is visible from the front of the card when the card is displayed on a display rack. To this end, as illustrated in FIG. 9, the front leaf 12 and rear leaf 14 can be folded into overlying relationship, and the third flap 26 can then be folded rearwardly into adjacent overlying relationship with the outside surface of the rear leaf 14. Alternatively, the third leaf 26 can be folded into overlying relationship with the inside surface of the rear leaf 14, and then the front leaf 12 can be folded into overlying relationship with the third leaf 26. When the third leaf is folded in the above manner, the flap 32 is visible from the front of the card over the top of the folded leaves. Likewise, the social expression 62 on flap 32 is also visible over the top of the card to provide an indication of the sending situation for the card.

When the greeting card is folded in this manner, the card can be located on a display rack and supported on its bottom edge along with a plurality of other cards. The additional social expression on the flap 32 of the card provides a general idea of the sending situation for the greeting card, and as such, provides a locating device or caption to aid the purchaser in locating an appropriate greeting card on the display rack for a particular sending situation.

Further, after the card is purchased and is folded and adhesively secured as described above for sending or mailing, this additional social expression on the flap 32 provides the recipient with a general idea of the sending situation for the greeting card before the greeting card is even opened (e.g., as shown in FIG. 8).

Accordingly, as described above, the present invention provides a novel and unique structure for a greeting card. The greeting card structure comprises a combined greeting card and envelope which is simple and easy to use, reduces material, labor and display costs, and provides an additional social expression and/or artwork during display of the greeting card, as well as upon receipt of the card.

With the above discussion in mind, the invention has been shown and described with respect to certain preferred embodiments, however it should be obvious that equivalent alterations and modifications will occur to others skilled in the art upon their reading and understanding of the specification. For example, the adhesive structure 38 could be formed on one of the other leaves, e.g., the rear surface 70 of the rear leaf 14, as shown in FIGS. 10 and 11, to adhesively secure the flap to the rear leaf.

Further, as discussed above, the greeting card portion of the greeting card structure could be formed from more (or less) than two leaves. For example, if the greeting card were formed from a single leaf, an additional leaf could extend outwardly from an edge of the single leaf, and could then be foldable into overlying relation with the front surface of the single leaf. A flap on the additional leaf could be foldable rearwardly into overlying relation with the rear surface of the single leave to adhesively secure the additional leaf to the single leaf.

On the other hand, if the greeting card were formed from more than two leaves, for example, three leaves joined at their edges (i.e., like a "tablet"), an additional leaf could extend downwardly from the middle leaf and could be folded into overlying relationship with the front leaf when the front and rear leaves are folded into overlying relation with the middle leaf. The present invention includes all such equivalent alterations and modifications and is limited only by the scope of the following claims.

What is claimed is:

1. A greeting card assembly, consisting of:

(a) three leaves joined together and folded relative to each other into adjacent overlying relationship to form a greeting card, said leaves including a front leaf and a rear leaf, said front leaf having a social expression thereon relating to a sending situation for the greeting card, said social expression on said front leaf being visible when the leaves are folded together; and (b) a third leaf joined to said rear leaf and foldable into overlying adjacent relationship with said front leaf, such that said rear leaf and said third leaf enclose and protect the front leaf;

said third leaf also being foldable into overlying adjacent relation with said rear leaf, said third leaf having a locating device integrally attached thereto which is visible when said third leaf is folded against said rear leaf, said locating device also including social expression thereon which relates to the sending situation for the greeting card.

2. A greeting card assembly according to claim 1, said third leaf including an inside surface which is foldable into adjacent relation with said first leaf, and an outside surface which includes address information thereon.

3. A greeting card assembly according to claim 1, said leaves each having a top edge, a bottom edge, and side edges interconnecting the top and bottom edges, said front and rear leaves being joined together along one of their side edges, the top edge of said third leaf being joined to one of the edges of said rear leaf, and said locating device being joined to the bottom edge of said third leaf.

4. A greeting card assembly according to claim 1, wherein said leaves are formed in one piece.

5. A greeting card assembly according to claim 1, said third leaf being joined to said rear leaf along a first perforated score line and removable therefrom by tearing said third leaf along said score line.

6. A greeting card assembly according to claim 1, said leaves and said additional leaf each having substantially the same dimensions.

7. A greeting card assembly, consisting of:

(a) a plurality of leaves joined together and folded relative to each other into adjacent overlying relationship to form a greeting card, said plurality of leaves including a front leaf and a rear leaf, said front leaf having a social expression thereon relating to a sending situation for the greeting card, said social expression on said front leaf being visible when the plurality of leaves are folded together; and (b) a third leaf joined to said rear leaf and foldable into overlying adjacent relationship with said front leaf, such that said rear leaf and said third leaf enclose and protect the remaining leaves;

(1) said third leaf also being foldable into overlying adjacent relation with said rear leaf, said third leaf having a locating device integrally attached thereto which is visible when said third leaf is folded against said rear leaf, said locating device also including social expression thereon which relates to the sending situation for the greeting card;

(2) said leaves being folded relative to each other into adjacent overlying relationship to form a greeting card; and (3) said third leaf being folded into overlying adjacent relationship with said front leaf such that said rear leaf and said third leaf enclose and protect the remaining leaves.

8. A multi-leaved social expression card with an integral envelope, consisting of:

(a) first and second leaves joined together along a first fold line, each of said first and second leaves having an inside surface and an outside surface, said first and second leaves being foldable into overlying relationship with each other to form a social expression card such that the inside surfaces of said first and second leaves are adjacent each other;

(b) a third leaf joined to a bottom edge of said second leaf along a second fold line perpendicular to said first fold line, said third leaf being foldable into overlying, adjacent relationship with said first leaf such that said third leaf covers substantially the entire outer surface of said first leaf;

(c) a flap joined to said third leaf along a third fold line parallel said second fold line, said flap having an inside surface and an outside surface, said flap being foldable into overlying adjacent relationship with said second leaf when said first, second, and third leaves are folded together; and (d) an adhesive structure for adhesively securing the inside surface of said flap to said second leaf to form an envelope;

(1) said third leaf being foldable along said second fold line into overlying, adjacent relationship against said second leaf;

(2) said flap extending outwardly from said third fold line an amount sufficient such that said flap is visible when said third leaf is folded against said second leaf and said first and second leaves are folded together; and (3) said flap including social expression on the outside surface thereof which is visible when said third leaf is folded against said second leaf.

9. A multi-leaved social expression card according to claim 8:

(1) said first, second, and third leaves each having a top edge, bottom edge, and side edges, said side edges interconnecting the top and bottom edges;

(2) said first and second leaves being joined together along one of their side edges;

(3) the top edge of said third leaf being joined to a bottom edge of said second leaf; and (4) said flap being joined to the bottom edge of said third leaf.

10. A multi-leaved social expression card according to claim 9, said first leaf having a social expression on the outer surface thereof.

11. A multi-leaved social expression card according to claim 9, said adhesive structure comprising an adhesive strip with a peel-away cover.

12. A multi-leaved social expression card according to claim 9, said flap being relatively smaller than said second leaf, and the outer surface of said flap including a social expression which is visible when said flap is adhesively secured to said second leaf.

13. A multi-leaved social expression card according to claim 9, said first, second, and third leaves being formed in one piece.

14. A multi-leaved social expression card according to claim 9, said second and third fold lines being perforated to enable said third leaf to be easily separated from said second leaf and said flap by tearing along the perforated fold lines.

15. A multi-leaved social expression card according to claim 9, said first, second, and third leaves all having substantially the same dimensions, 16. A multi-leaved social expression card according to claim 9, said adhesive structure on said third leaf comprising a gummed adhesive.

17. A tri-leaved social expression card with an integral envelope, consisting of:

(a) first and second leaves joined together along a first fold line, each of said first and second leaves having an inside surface and an outside surface, said first and second leaves being foldable into overlying relationship with each other to form a social expression card such that the inside surfaces of said first and second leaves are adjacent each other;

(b) a third leaf joined to said second leaf along a second fold line, said third leaf being foldable into overlying, adjacent relationship with said first leaf such that said third leaf covers substantially the entire outer surface of said first leaf;

(c) a flap joined to said third leaf along a third fold line, said flap having an inside surface and an outside surface, said flap being foldable into overlying adjacent relationship with said second leaf when said first, second, and third leaves are folded together; and (d) an adhesive structure for adhesively securing the inside surface of said flap to said second leaf to form an envelope;

(1) said first, second, and third leaves each having a top edge, bottom edge, and side edges, said side edges interconnecting the top and bottom edges;

(2) said first and second leaves being joined together along one of their side edges;

(3) the top edge of said third leaf being joined to a bottom edge of said second leaf;

(4) said flap being joined to the bottom edge of said third leaf;

(5) said flap being relatively smaller than said second leaf; and (6) the outside surface of said flap including a social expression which is visible when said flap is adhesively secured to said second leaf.

18. A tri-leaved social expression card with an integral envelope, consisting of:

(a) first and second leaves joined together along a first fold line, each of said first and second leaves having an inside surface and an outside surface, said first and second leaves being foldable into overlying relationship with each other to form a social expression card such that the inside surfaces of said first and second leaves are adjacent each other;

(b) a third leaf joined to said second leaf along a second fold line which is perpendicular to said first fold line, said third leaf being foldable into overlying, adjacent relationship with said first leaf such that said third leaf covers substantially the entire outer surface of said first leaf;

(c) a flap joined to said third leaf along a third fold line, said flap having an inside surface and an outside surface, said flap being foldable into overlying adjacent relationship with said second leaf when said first, second, and third leaves are folded together; and (d) an adhesive structure for adhesively securing the inside surface of said flap to said second leaf to form an envelope;

(1) said first, second, and third leaves each having a top edge, bottom edge, and side edges, said side edges interconnecting the top and bottom edges;

(2) said first and second leaves being joined together along one of their side edges;

(3) the top edge of said third leaf being joined to a bottom edge of said second leaf;

(4) said flap being joined to the bottom edge of said third leaf; and (5) said second and third fold lines being perforated to enable said third leaf to be easily separated from said second leaf and said flap by tearing along the perforated fold lines.

19. A greeting card assembly according to any of claims 8, 11, 16, 17 or 18, said adhesive structure being affixed to said flap.

20. A greeting card assembly according to any of claims 8, 11, 16, 17 or 18, said adhesive structure being affixed to said second leaf.

21. A method of sending and receiving a social expression card, comprising the steps of:

providing first and second leaves joined together along a first fold line and foldable into overlying adjacent relationship with each other to form the social expression card, said first leaf including social expression thereon which is visible when said first and second leaves are folded together, providing a third leaf joined to said second leaf along a second fold line and foldable into overlying adjacent relation with said first leaf when said first and second leaves are folded together, and providing a flap joined to said third leaf along a third fold line and foldable relative to said third leaf, said flap including social expression thereon, folding said first and second leaves together into overlying relationship to form the social expression card, folding said third leaf into overlying adjacent relationship with said first leaf such that said third leaf covers an outer surface of said first leaf, and folding said flap into overlying adjacent relationship with said second leaf such that said social expression on said flap is visible, and adhesively securing said flap to said second leaf to form an envelope.

22. A method as in claim 21, further including the initial step of displaying the social expression card by initially folding said third leaf into overlying adjacent relationship against said second leaf, said flap extending away from said third leaf an amount sufficient such that the social expression on said flap is visible when said third leaf is folded against said second leaf.

23. A method as in claim 22, wherein said first and second leaves each include inside surfaces which are visible when said card is in an open position, and outside surfaces which are visible when said card is in a closed position, said third leaf being folded into adjacent overlying relation with the outside surface of said second leaf when said card is initially displayed.

* * * * *